US006028294A

United States Patent [19]

Nilson

[11] Patent Number: 6,028,294

[45] Date of Patent: Feb. 22, 2000

[54] HEATER ASSEMBLY

[75] Inventor: Lee A. Nilson, Greenacres, Wash.

[73] Assignee: Kim Hotstart Manufacturing Company

[21] Appl. No.: 08/857,101

[22] Filed: May 15, 1997

[51] Int. Cl.[7] ..... H05B 3/06

[52] U.S. Cl. ..... 219/523; 219/522; 392/498; 392/501; 392/503

[58] Field of Search ..... 219/522–23, 437; 392/449, 501, 451, 497, 498

[56] References Cited

U.S. PATENT DOCUMENTS

| | | | |
|---|---|---|---|
| 4,506,140 | 3/1985 | Armstrong | 219/523 |
| 4,551,613 | 11/1985 | Yashfe | 219/523 |
| 4,687,905 | 8/1987 | Cunningham | 392/497 |
| 5,113,057 | 5/1992 | Tsai | 219/523 |
| 5,263,116 | 11/1993 | Hammond | 392/451 |
| 5,506,931 | 4/1996 | Leon | 392/501 |

*Primary Examiner*—Teresa Walberg
*Assistant Examiner*—Thor Campbell
*Attorney, Agent, or Firm*—Wells, St. John, Roberts, Gregory & Matkin, P.S.

[57] ABSTRACT

A heating assembly for imparting energy to a liquid which is enclosed in a vessel, is described and which includes a base plate borne by the vessel and having a first portion which has a given first mass, and a second portion which is made integral with the first portion and which has a given second mass; a heating element borne by the second portion of the base plate and disposed in heat emitting relation relative to the liquid in the vessel; and a temperature sensor mounted in heat sensing relation relative to the second portion of the base plate.

24 Claims, 3 Drawing Sheets

HEATER ASSEMBLY

TECHNICAL FIELD

The present invention relates generally to a heating assembly, and more specifically, to a heating assembly which imparts energy to a liquid which is enclosed in a vessel.

BACKGROUND OF THE INVENTION

The prior art is replete with numerous examples of heating assemblies which are operable to impart energy to a liquid which is enclosed within a vessel. For example, so-called "block heaters" have been utilized for more than 50 years on internal combustion engines to maintain lubricating fluids in the motors at a given temperature to facilitate rapid ignition at cold starting temperatures. Other heating assemblies have been designed for similar or other purposes. Commonly, these assemblies include a heating element, a thermostat, and a base plate for securing the heating element in an appropriate orientation relative to the vessel that encloses the fluid. As should be understood, the thermostat has typically facilitated the energizing, and deenergizing of the heating element under appropriate operational conditions.

While these heating assemblies have operated with varying degrees of success, they have shortcomings which have detracted from their usefulness. More specifically, under some operational conditions, heat energy from the fluid enclosed within the vessel may move into the surrounding vessel, and base plate supporting the heating element such that the accompanying thermostat prematurely deenergizes the heating element. Further, in a "dry tank" condition, that is, where the heating element is not immersed in the fluid; the base plate, and the vessel then become a heat sink, that is, absorbing the excess heat energy produced by the heating element. This absorption of heat energy, if left unchecked, may cause the heating element to degrade or become permanently damaged before the accompanying thermostat can deenergize same. Yet further, if the base plate effectively acts as a heat sink, it will prevent the heating element from becoming energized, when the tank is subsequently filled with fluid, until such time as the heat energy in the base plate flows from the base plate into the surrounding fluid thus allowing the thermostat to reset.

Yet a further shortcoming with the prior art devices relates to characteristics inherent in their design. For example, designers of these previous assemblies have attempted to address the problems noted above by providing remote temperature sensing, and various mechanical arrangements which have increased the complexity of the heating element and its associated costs of manufacturing. These associated design changes have not measurably increased the reliability of same, and under some environmental conditions, may cause the assembly to fail.

An improved heating assembly is the subject matter of the present application.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
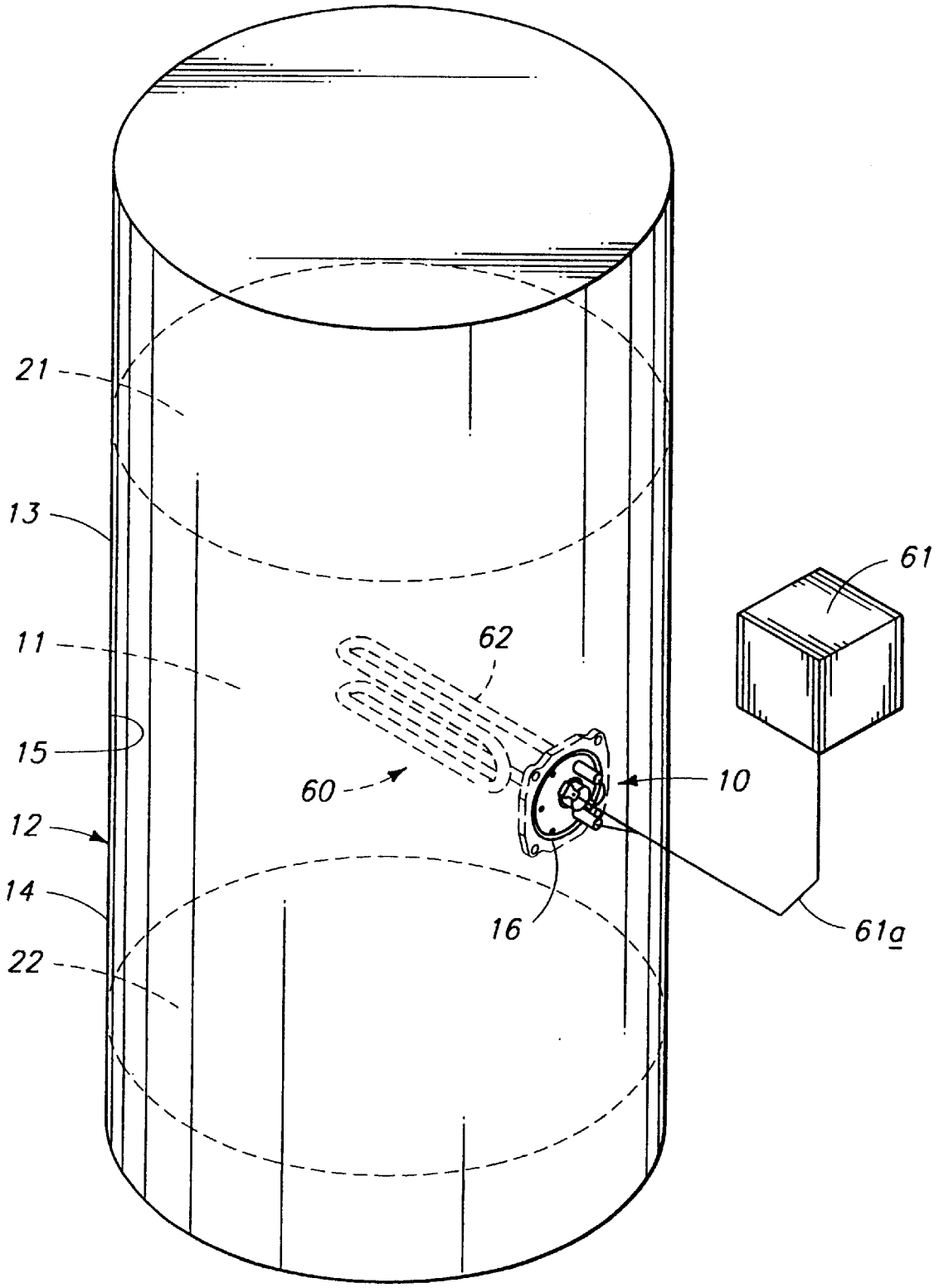
FIG. 1 is a greatly simplified view of the present invention shown in a typical operative configuration.

This disclosure of the invention is submitted in furtherance of the constitutional purposes of the U.S. Patent Laws "to promote the progress of science and useful arts" (Article 1, Section 8).

In accordance with one aspect of the present invention, the heating assembly is operable for imparting energy to a liquid which is enclosed in a vessel and which comprises:

- a base plate borne by the vessel and having a first portion which has a given first mass, and a second portion which is made integral with the first portion, and which has a given second mass;
- a heating element borne by the second portion of the base plate and disposed in heat emitting relation relative to the liquid in the vessel; and
- a temperature sensor mounted in heat sensing relation relative to the second portion of the base plate.

Another aspect of the present invention relates to a heating assembly for imparting heat energy to a liquid which is enclosed in a vessel and which comprises:

- a base plate borne by the vessel and having a first portion which has a given first mass, a second portion which is made integral with the first portion and which has a given second mass, and wherein the first and second masses are in a proportional relationship of about 3:1 to about 5:1;
- a heating element borne by the second portion of the base plate and disposed in heat emitting relation relative to the liquid in the vessel;
- a source of electricity coupled with the heating element and which energizes same; and
- a temperature sensor having a maximum threshold temperature and which is mounted in heat sensing relation relative to the second portion of the base plate, and coupled in controlling relation relative to the source of electricity, the temperature sensor deenergizing the heating element when the maximum threshold temperature is realized.

Yet still a further aspect of the present invention relates to a heating assembly for imparting heat energy to a liquid which is enclosed in a vessel, the heating assembly comprising:

- a base plate borne by the vessel and having a first portion which has a given first mass, and a second portion which is made integral with the first portion and which has a given second mass;
- a heating element borne by the second portion of the base plate and disposed in heat emitting relation relative to the liquid in the vessel;
- a source of electricity coupled with the heating element and which energizes same; and
- a temperature sensor having a maximum threshold temperature and which is mounted in heat sensing relation relative to the second portion of the base plate, and coupled in controlling relation relative to the source of electricity, the temperature sensor deenergizing the heating element when the maximum threshold temperature is realized, and wherein the mass of the first and second portions of the base plate are in such a proportional relationship that the cumulative heat energy imparted by the liquid in the vessel and the heating element to the second portion of the base plate does not cause the temperature sensor to reach the maximum temperature threshold, and wherein the heat energy imparted to the second portion of the base plate, in the absence of liquid in contact with the heating element, causes the temperature sensor to reach the maximum temperature threshold prior to any heat-related damage occurring to the heating element.

Referring now to FIG. 1, the heating assembly 10 of the present invention and which effectively imparts energy to a liquid 11 which is enclosed within a vessel 12 is illustrated in a typical configuration. The vessel 12 is defined by a wall 13 which has an exterior facing surface 14, and an opposite interior facing surface 15. An aperture 16, having a given diameter, is formed in the wall 13. Further, the liquid 11 is shown at two levels, a first fluid level 21, whereby the heating assembly 10 is immersed in the fluid, and a second fluid level 22, whereby the heating assembly 10 is exposed, and not surrounded by fluid (a dry tank condition). These individual fluid levels will be discussed in connection with the operation of the present device 10 in the paragraphs which follow.

Figure 2:
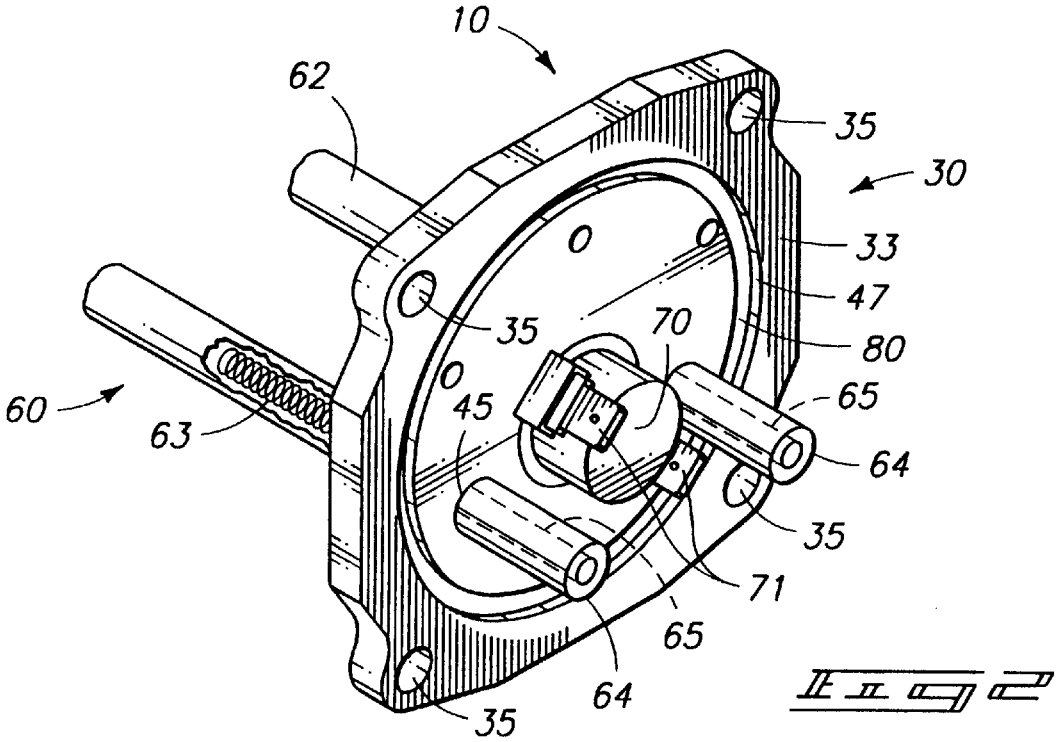
FIG. 2 is a first, fragmentary, perspective, view of the heating assembly of the present invention.
Figure 5:
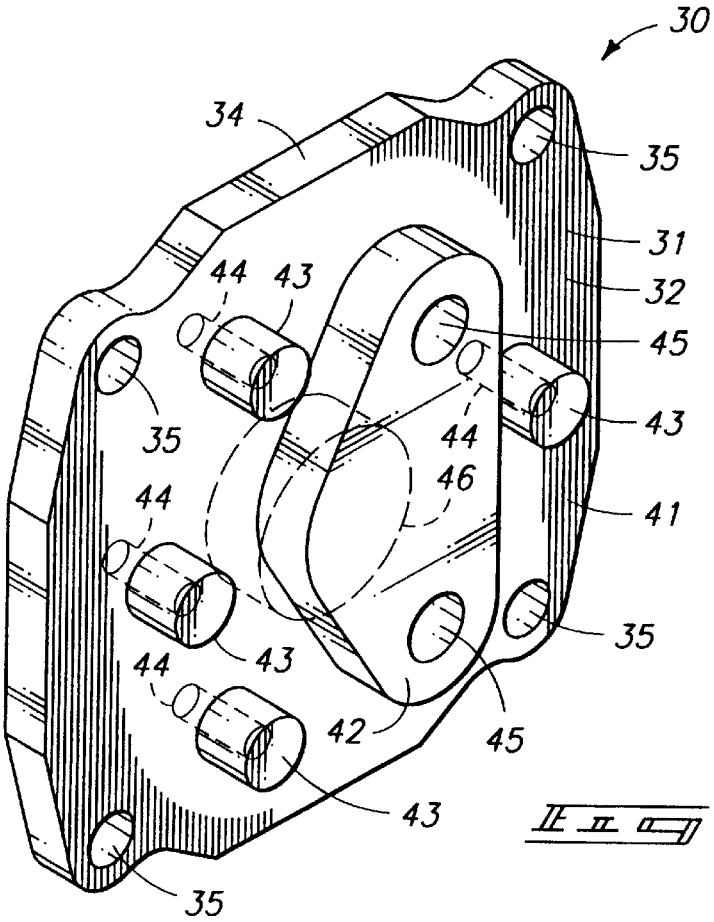
FIG. 5 is a perspective view of the top surface of the base plate employed with the heating assembly of the present invention.

Referring now to FIGS. 2 and 5, the heating assembly 10 of the present invention includes a base plate which is generally indicated by the numeral 30. The base plate has a main body 31, which has a forward facing surface 32; and an opposite, rearward facing surface 33, a peripheral edge 34; and mounting apertures 35, which are formed in the main body 31 and which are positioned adjacent the peripheral edge 34. The mounting apertures 35 receive suitable fasteners, not shown, and which threadably secures the base plate in occluding relation relative to the aperture 16 which is formed in the wall 13 of the vessel 12.

The base plate 30 includes a first portion 41, which has a given first mass, and a second portion 42 which is made integral with the first portion 41, and which has a given second mass. The mass of the first and second portions are in a proportional relationship of about 3:1 to about 5:1. For example, in a heating assembly 10 which is operable to emit about 2,500 watts of heat, the first portion 41 of the base plate 30 weighs about 3.71 ounces, and the second portion 42 of the base plate 30 weighs about 0.91 ounces when the base plate is fabricated from aluminum. It has been discovered that the proportional mass relationship of the first and second portions imparts improved performance characteristics heretofore unattainable in the prior art assemblies which have been used for substantially identical purposes. These performance characteristics will be discussed in further detail hereinafter.

Figure 3:
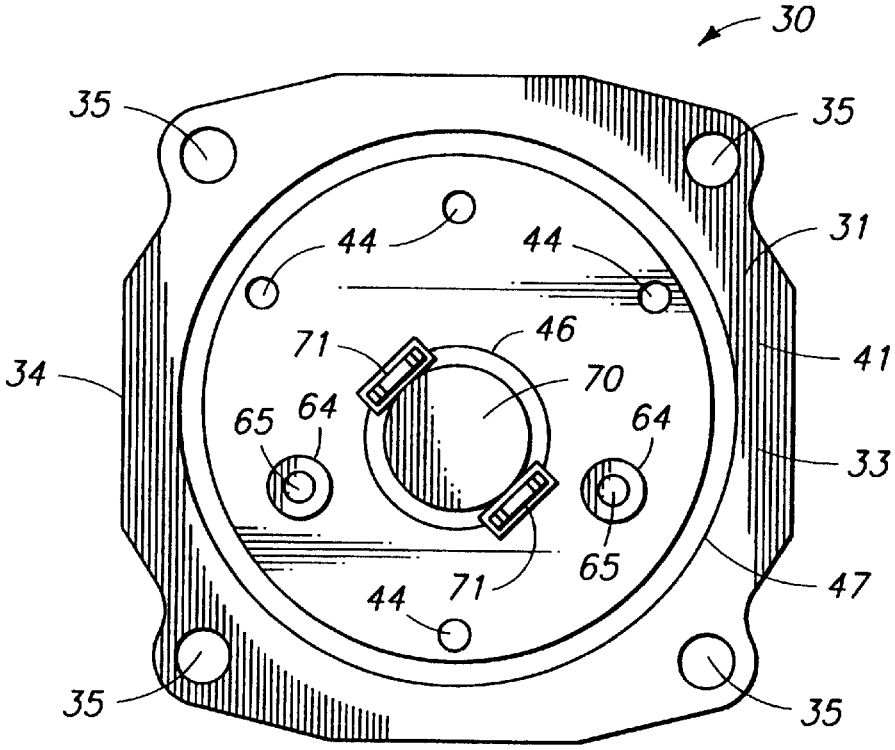
FIG. 3 is a bottom, plan view of the base plate employed with the heating assembly of the present invention.

A plurality of receiving members 43 are made integral with the first portion 41, and are disposed in a predetermined pattern as shown. The individual receiving members have channels formed therein 44, and which are accessible from the rearward facing surface 33. These channels 44 are operable to threadably mate with various fasteners (not shown), which may engage same from the rearward facing surface 33. A pair of heating element apertures 45 (FIG. 5), are formed in the second portion 42 and extend therethrough to the rearward facing surface 33. As best seen by reference to FIGS. 3 and 5, a cavity 46 is formed in the second portion 42 of the base plate 30 and is accessible from the rearward facing surface 33. Yet further, a gasket or o-ring groove 47 is formed in the rearward facing surfacing surface 33.

Figure 4:
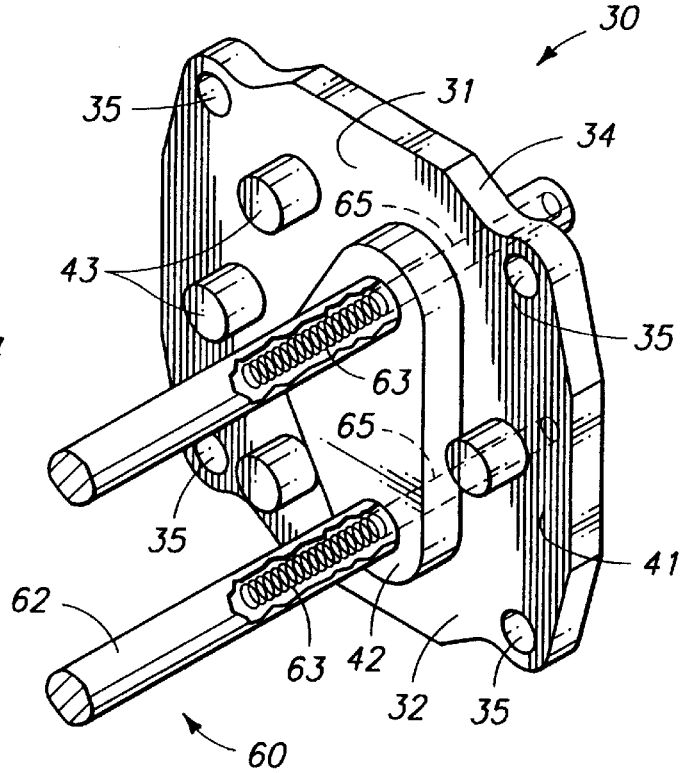
FIG. 4 is a second, fragmentary, perspective view of the heating assembly of the present invention.

A heating element 60 of conventional design is matingly received in the apertures 45 which are formed in the second portion 42 of the base plate 30. The heating element 60 is operable, when energized by a source of electricity 61, to produce about 1,000 watts to about 7,000 watts of heat energy. An electrical conduit 61A electrically couples the source of electricity 61 with the heating element 60 and an accompanying temperature sensor which will be discussed below. The heating element has a main body 62 which encloses a heating filament 63, as shown in FIG. 4. Further, the main body 62 has terminal portions 64 which extends substantially normally outwardly relative to the rearward facing surface 33 of the base plate 30. The terminal portions 64 enclose a cold pin 65 which electrically couples the heating filament 63 with the source of electricity 61. The cold pin terminates near (less than about 0.5 inches) from the forward facing surface 32 of the second portion 42. The cold pin is electrically coupled to the electrical conduit 61A.

A temperature sensor 70, having a maximum threshold temperature of about 150 degrees F. to about 220 degrees F. is mounted in heat-sensing relation relative to the second portion 42 of the base plate 30 and in the cavity 46. The temperature sensor which can constitute a bi-metal thermostat includes a pair of electrical terminals 71 which allows it to be electrically coupled in controlling relation relative to the source of electricity 61 and the heating element 60 by means of the electrical conduit 61A. The temperature sensor 70 deenergizes the heating element 60 when the maximum threshold temperature is realized. As best seen by reference to FIG. 2, an o-ring 80 of traditional design is received in the o-ring groove 47. As such, the o-ring 80 allows the base plate 30 to be fluid sealably mounted on the interior facing surface 15 of the vessel 12, and in occluding relation relative to the aperture 16. The base plate 30 may be manufactured from metals which are preferably selected from the group comprising aluminum, copper, brass, steel, or similar rigid materials or combinations thereof. Further, the base plate 30 may be manufactured from a homogeneous or non-homogeneous material, provided the mass of the first portion 41 of the base plate 30, and the mass second portion 42 of the base plate remains in a proportional range of about 3:1 to about 5:1. In this mass range the base plate operates in a fashion whereby the cumulative heat energy imparted by the heating element 60, and the liquid 11, to the second portion 42 of the base plate 30 does not cause the temperature sensor 70 to reach the maximum threshold temperature. This, of course, occurs when the heating assembly is immersed, as would be the case when the fluid level 21 is present (FIG. 1). On the other hand, in the absence of liquid 11 in contact with the heating assembly 10, as would be the case when the fluid level 22 is present (dry tank), the proportional mass relationships of the first and second portion 41 and 42 are such that heat energy imparted by the heating element 62 to the base plate 30 causes the temperature sensor 70 to reach the maximum threshold temperature prior to any heat related damage occurring to the heating element 60.

OPERATION

The operation of the described embodiment of the present invention is believed to be readily apparent and is briefly summarized at this point. In its broadest sense, the heating assembly 10 for imparting energy to a liquid 11, which is enclosed in a vessel 12, comprises a base plate 30 which is borne by the vessel and which has a first portion 41 having a given first mass, and a second portion 42 which is made integral with the first portion, and which has a given second mass. The heating assembly further includes a heating element 60 borne by the second portion 42 of the base plate 30 and disposed in heat emitting relation relative to the liquid 11 in the vessel 12. As best seen in FIG. 2, a temperature sensor 70 is mounted in heat sensing relation relative to the second portion 42 of the base plate 30.

As should be understood, the heating element 60 is coupled with a source of electricity 61 for energizing the heating element 60 and the temperature sensor 70 is coupled in controlling relation relative to the source of electricity 61, and the heating element 60. As earlier discussed, the temperature sensor 70 has a maximum temperature threshold. When this temperature threshold is met, the temperature sensor deenergizes the heating element thereby preventing any heat related damage to same. It should be understood that the mass of the first and second portions of the base plate are in such a proportional relationship that heat energy imparted to the second portion 42 of the base plate 30, in the absence of liquid in contact with the heating element 40, causes the temperature sensor 70 to reach the maximum temperature threshold prior to any heat related damage occurring to the heating element 60. As earlier disclosed, the heating element produces about 1,000 watts to about 7,000 watts. Further, the mass of the first and second portions 41 and 42 of the base plate 30, is in a range of about 3:1 to about 5:1.

Therefore, the present heating assembly 10 for imparting heat energy to a liquid 11 which is enclosed in a vessel 12 comprises a base plate 30 borne by the vessel 12 and having a first portion 41 which has a given first mass, and a second portion 42 which is made integral with the first portion 41, and which has a given second mass; a heating element 60 borne by the second portion 42 of the base plate 30 and disposed in heat emitting relation relative to the liquid 11 in the vessel 12; a source of electricity 61 coupled with the heating element 60, and which energizes same; and a temperature sensor 70 having a maximum threshold temperature, and which is mounted in heat sensing relation relative to the second portion 42 of the base plate 30 and coupled in controlling relation relative to the source of electricity 61, the temperature sensor 70 deenergizing the heating element 60 when the maximum threshold temperature is realized, and wherein the mass of the first and second portions of the base plate 30 are in such a proportional relationship that the cumulative heat energy imparted by the liquid 11, in the vessel 12, and the heating element 60 to the second portion 42 of the base plate 30 does not cause the temperature sensor 70 to reach the maximum temperature threshold, and wherein the heat energy imparted to the second portion 42 of the base plate 30 in the absence of liquid in contact with the heating element 22 causes the temperature sensor to reach the maximum temperature threshold prior to any heat related damage occurring to the heating element 70.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the Doctrine of Equivalents.

I claim:

1. A heating assembly for imparting energy to a liquid which is enclosed in a vessel, the heating assembly comprising:

a base plate borne by the vessel and having a first portion 41 which has a given first mass, and a second portion 42 which is made integral with the first portion and which has a given second mass and wherein the mass of the first portion in relation to the mass of the second portion of the base plate is in a range of about 3:1 to about 5:1;

a heating element borne by the second portion of the base plate and disposed in heat emitting relation relative to the liquid in the vessel; and a temperature sensor mounted in heat sensing relation relative to the second portion of the base plate.

2. A heating assembly as claimed in claim 1, wherein the heating element is coupled with a source of electricity for energizing the heating element, and the temperature sensor is coupled in controlling relation relative to the source of electricity.

3. A heating assembly as claimed in claim 2, wherein heat energy is imparted to the base plate by the liquid in the vessel when the liquid is in contact with the heating element and the base plate, and wherein the temperature sensor has a maximum temperature threshold, and wherein the temperature sensor deenergizes the heating element when the maximum temperature threshold of the temperature sensor is realized.

4. A heating assembly as claimed in claim 3, wherein the mass of the first and second portions of the base plate are in such a proportional relationship that the cumulative heat energy imparted by the liquid in the vessel and the heating element to the second portion of the base plate does not cause the temperature sensor to reach the maximum temperature threshold.

5. A heating assembly as claimed in claim 4, wherein the mass of the first and second portions of the base plate are in such a proportional relationship that the heat energy imparted to the second portion of the base plate, in the absence of liquid in contact with the heating element, causes the temperature sensor to reach the maximum temperature threshold prior to any heat related damage occurring to the heating element.

6. A heating assembly as claimed in claim 5 wherein the base plate has front and rear surfaces, and wherein the front surface is exposed to the liquid in the vessel, and wherein a cavity is formed in the rear surface of the base plate, and which matingly receives the temperature sensor.

7. A heating assembly as claimed in claim 6, wherein the heating element has a heat output of about 1,000 watts to about 7,000 watts, and wherein the threshold temperature of the temperature sensor is about 150 degrees F. to about 220 degrees F.

8. A heating assembly as claimed in claim 7, wherein the base plate is manufactured from a metal which is selected from group that comprises aluminum, copper, brass, steel and combinations thereof.

9. A heating assembly as claimed in claim 8, wherein the base plate is manufactured from a substantially homogeneous material.

10. A heating assembly as claimed in claim 8, wherein the base plate is manufactured from a nonhomogeneous material.

11. A heating assembly as claimed in claim 9, wherein the heating element comprises an exterior facing heat conducting wall which encloses a heating filament, and wherein a cold pin electrically couples the heating filament with the source of electricity, and terminates at a location which is less than about 0.5 inches from the front surface of the second portion.

12. A heating assembly for imparting heat energy to a liquid which is enclosed in a vessel, the heating assembly comprising:

a base plate borne by the vessel and having a first portion which has a given first mass, a second portion which is made integral with the first portion and which has a given second mass, and wherein the first and second masses are in a proportional relationship of about 3:1 to about 5:1;

a heating element borne by the second portion of the base plate and disposed in heat emitting relation relative to the liquid in the vessel;

a source of electricity coupled with the heating element and which energizes same; and a temperature sensor having a maximum threshold temperature and which is mounted in heat sensing relation relative to the second portion of the base plate and coupled in controlling relation relative to the source of electricity, the temperature sensor deenergizing the heating element when the maximum threshold temperature is realized.

13. A heating assembly as claimed in claim 12 wherein the mass of the first and second portions of the base plate are in such a proportional relationship that the cumulative heat energy imparted by the liquid in the vessel, and the heating element to the second portion of the base plate does not cause the temperature sensor to reach the maximum temperature threshold.

14. A heating assembly as claimed in claim 13, wherein the mass of the first and second portions of the base plate are in such a proportional relationship that the heat energy imparted to the second portion of the base plate, in the absence of liquid in contact with the heating element, causes the temperature sensor to reach the maximum temperature threshold prior to any heat related damage occurring to the heating element.

15. A heating assembly as claimed in claim 14, wherein the base plate has front and rear surfaces, and wherein the front surface is exposed to the liquid in the vessel, and wherein a cavity is formed in the rear surface of the base plate and which matingly receives the temperature sensor.

16. A heating assembly as claimed in claim 15, wherein the heating element has a heat output of about 1,000 watts to about 7,000 watts, and wherein the threshold temperature of the temperature sensor is about 150 degrees F. to about 220 degrees F.

17. A heating assembly as claimed in claim 16, wherein the base plate is manufactured from a metal which is selected from a group that comprises aluminum, copper, brass, steel and compositions thereof.

18. A heating assembly as claimed in claim 17, wherein the base plate is manufactured from a substantially homogeneous material.

19. A heating assembly as claimed in claim 17, wherein the base plate is manufactured from a nonhomogeneous material.

20. A heating assembly as claimed in claim 19, wherein the heating element comprises an exterior facing heat conducting wall which encloses a heating filament, and wherein a cold pin electrically couples the heating filament with the source of electricity.

21. A heating assembly for imparting heat energy to a liquid which is enclosed in a vessel, the heating assembly comprising:

a base plate borne by the vessel and having a first portion which has a given first mass, and a second portion which is made integral with the first portion, and which has a given second mass and wherein the mass of the first portion of the base plate in relation to the second portion of the base plate is in a range of about 3:1 to about 5.1;

a heating element borne by the second portion of the base plate and disposed in heat emitting relation relative to the liquid in the vessel;

a source of electricity coupled with the heating element and which energizes same; and a temperature sensor having a maximum threshold temperature of about 150 degrees F. to about 220 degrees F. and which is mounted in heat sensing relation relative to the second portion of the base plate, and wherein the temperature sensor is coupled in controlling relation relative to the source of electricity, and wherein the temperature sensor deenergizes the heating element when the maximum threshold temperature is realized, and wherein the mass of the first and second portions of the base plate are in such a proportional relationship that the cumulative heat energy imparted by the liquid in the vessel, and the heating element to the second portion of the base plate does not cause the temperature sensor to reach the maximum temperature threshold, and wherein the heat energy imparted to the second portion of the base plate, in the absence of liquid in contact with the heating element, causes the temperature sensor to reach the maximum temperature threshold prior to any heat related damage occurring to the heating element.

22. A heating assembly as claimed in claim 21, wherein the heating element has a heat output of about 1,000 watts to about 7,000 watts.

23. A heating assembly as claimed in claim 22, wherein the base plate is manufactured from a substantially homogeneous material.

24. A heating assembly as claimed in claim 22, wherein the base plate is manufactured from a nonhomogeneous material.

* * * * *

UNITED STATES PATENT AND TRADEMARK OFFICE

CERTIFICATE OF CORRECTION

PATENT NO. : 6,028,294

DATED : February 22, 2000

INVENTOR(S) : Lee A. Nilson

It is certified that error appears in the above-identified patent and that said Letters Patent is hereby corrected as shown below:

In column 6, line 2, please delete the numbers "41".
In column 6, line 3, please delete the numbers "42".

Signed and Sealed this

Thirteenth Day of February, 2001

*Attest:*

Nicholas P. Godici

NICHOLAS P. GODICI

*Attesting Officer*

*Acting Director of the United States Patent and Trademark Office*